United States Patent [19]

Krekács et al.

[11] Patent Number: 4,465,128

[45] Date of Patent: Aug. 14, 1984

[54] PLATE FLOOR HEAT EXCHANGER

[75] Inventors: Sándor Krekács; Zoltán Pálfi, both of Budapest, Hungary

[73] Assignee: Országos Köolaj és Gázipari Tröszt, Budapest, Hungary

[21] Appl. No.: 255,992

[22] Filed: Apr. 21, 1981

[30] Foreign Application Priority Data

Apr. 22, 1980 [HU] Hungary ..... 977

[51] Int. Cl.[3] ..... F28F 1/32

[52] U.S. Cl. ..... 165/151; 165/182

[58] Field of Search ..... 165/148–152, 165/171, 181, 182; 29/157.3 A, 157.3 B

[56] References Cited

U.S. PATENT DOCUMENTS

| | | | |
|---|---|---|---|
| 1,840,651 | 1/1932 | Bassler | 165/181 |
| 2,055,499 | 9/1936 | Kirig | 165/151 |
| 2,540,339 | 2/1951 | Kritzer | 165/181 X |
| 3,250,324 | 5/1966 | Hicks | 165/181 X |
| 3,438,433 | 4/1969 | Gunter | 165/151 |
| 3,916,989 | 11/1975 | Harada | 165/151 |

FOREIGN PATENT DOCUMENTS

| | | | |
|---|---|---|---|
| 627294 | 6/1927 | France | 29/157.3 A |

*Primary Examiner*—Sheldon J. Richter

*Attorney, Agent, or Firm*—Karl F. Ross; Herbert Dubno

[57] ABSTRACT

A plate floor heat exchanger has a plurality of conductive mutually parallel plates spaced apart by narrow gaps defined by spacer bands which can have a streamlined shape and each of which are traversed by a plurality of tubes extending perpendicular to the plates. The spaces between longitudinal edges of these bands define flow channels for a fluid in a heat exchange relationship with the fluid traversing the tubes.

6 Claims, 8 Drawing Figures

PLATE FLOOR HEAT EXCHANGER

FIELD OF THE INVENTION

The present invention relates to a plate floor heat exchanger which has at least two plate floors of optional profile and shape, which floors in at least one region of their surface are separated by a space and wherein, the heat exchanger has an optional cross sectional closed profile channel traversing the plate floors, and a spacer element among the plate floors fitted to the channel.

BACKGROUND OF THE INVENTION

A plate floor heat exchanger is particularly applicable with advantage wherever the heat-transfer coefficient of the medium flowing in the channel is much greater than that of the medium flowing among the plate floors. Such conditions exist, in general, in air coolers, air cooled condensors, air heaters, air radiators and air conditioning plants.

In known devices for such purposes one of the media taking part in the heat exchange flows in the closed profile channel of an optional cross section, while the other medium flows among the plate floors. The space between the plate floors is maintained by means of spacers which can be separate spacer elements (spacer rings) or flanges that are formed on the plate floor.

A characteristic of such devices is that the spacer elements, and channels, respectively, during operation generate significant resistance to flow of the medium along the state floors. In the "wind shadow" of channels and spacer elements, respectively, and thus along the sides thereof opposite the direction from which the flowing medium between the plate floors encounters them a so called "dead space" is formed within which heat transfer is brought about not by means of flow but practically only through convection.

As a consequence the surfaces defining the dead space practically do not take part in heat transfer. Moreover the turbulence disengagements developing in the dead space increase to a significant extent the resistance of medium and therefore, the flow of the medium in the space between the plate floors requires a rather greater input. If the spacer element is formed by the flanging-out of the plate floor, heat transfer will be impaired also by the thinning of the plate floor material as a consequence of the flanging-out.

To avoid or limit these disadvantages, different proposals have been made. The essence of these proposals is in the interest of reducing the resistance of the medium and the dead space by forming the channels of tubes having oval or elliptical cross section. The tubes are elongated in the flow direction of medium flowing along the plate floors. Such a solution is described in German Patent No. 2,123,723 other publications as well see: Transactions of ASME, Series "B", May 1966.

A characteristic of the oval tube construction and similar solutions is that, though the dead spaces are reduced in size they are not eliminated, and thus the flow properties of plate floor heat-exchangers shaped this way are more favorable, they can be improved still further.

In the use of oval or elliptical tubes it can be assured only with difficulty that the metal connection guaranteeing good heat conduction between the channel and plate floors will continue during the whole period of operation. Should a tube having such a cross section be placed under working or test pressure, the tube under the effect of pressure tends to assume circular cross-section. The repeated change of shape may loosen the metal connection between the tube and the plate floor, thus impairing heat transfer.

A tube having an oval or elliptical cross-section also has less strength and its fabrication is more complex a therefore more expensive.

OBJECT OF THE INVENTION

It is an object of the present invention to provide a plate floor heat exchanger which is free from the above disadvantages, i.e. in which dead spaces and turbulence disengagements increasing the resistance of medium do not develop.

SUMMARY OF THE INVENTION

In accordance with the invention, the resistance to flow of the medium of the plate floor heat exchanger is less than that of earlier heat exchangers at the same time its heat transfer factor is greater, and these favorable properties are achieved together with a simplification of fabrication.

The basis of the invention is the recognation of the fact that development of dead spaces behind the channels can be simply and effectively prevented by filling the space behind the channels along the plate floors with a solid material, thus creating a flow channel assuring laminar flow for the medium flowing along the plate floors.

Thus the thermodynamic properties of the heat exchanger and the resistance to flow of the medium, too, can be rendered independent of the cross-sectional shape of the channel.

In accordance with another embodiment of the invention the plate floor heat exchanger has at least two plate floors of optional profile and shape and which in at least one region of their surfaces are separated by a space and an optional cross sectional closed profile channel traversing the plate floors, and a spacer element amongst the plate floors fitting to the channel when the distance spacer element is a distance spacer band.

In one advantageous design of the plate floor heat exchanger according to the invention one distance spacer band at least is traversed at least by two channels in part, where the channels being advantageously tubes having circular cross-section.

An advantage of the shape according to the above design is that with the mounting of the spacer band clasping many channels, the manufacturing, maintenance of the heat exchanger are simpler.

In a further advantageous design of the plate floor heat exchanger according to the invention the width of the spacer band along the long axis changes, being preferably the greatest in the vicinity of the channel.

A further advantage of this design is that with such a construction of the spacer band the flow and thermodynamic characteristics of the heat exchanger can advantageously be varied, and be brought in accord with one another.

In accordance with another embodiment of the invention, in a further advantageous design of the plate floor heat exchanger the width of the spacer band between two locations of maximum width along the long axis continuously changes, and the first derivative of the function describing the change has between the two locations of maximum width following each other at most one region of negative sign and one region with a positive sign.

An advantage of the above design is that the width of the spacer band in sections between the channels can be reduced; thus the surface of plate floors taking part in the heat transfer can be increased. In addition because of the continuity of change of the width the flow properties of the heat exchanger can be formed favorably.

In a further advantageous design of the plate floor heat exchanger in accordance with the invention the side mantles of subsequent spacer bands of the plate floors and along the plate floors or at least one section of these mantles form a streamline flow space.

Another advantage of this construction is that the flowing medium between the plate floors in the streamline flow space shaped according to the above can be forced to flow with the least energy loss.

In yet another; advantageous arrangement of a plate floor heat exchanger according to the invention at least one part of the side mantle surface of the spacer band in indented, corrugated, knurled, and etched or has its surface area increased in another way.

In this case the turbulence generators formed on the side mantle of the spacer bands do not significantly increase the resistance to flow of the medium, instead they improve heat transfer and the heat transfer surface.

In another advantageous design of the plate floor heat exchanger according to the invention the axis of at least one spacer band is a two or three dimensional space curve.

Thus the flow direction of the flowing medium between the plate floors can be changed within the heat exchanger, and the residence time of the medium without decreasing the velocity can be increased.

In still another advantageous construction of the plate floor heat exchanger according to the invention on the surface of plate floors turbulence generators, preferably small ribs are provided which advantageously terminate in the neighborhood of the side mantle surfaces of the spacer bands.

Hence the turbulence generators formed on the surface of the plate floors further improve heat transfer, and spacer bands, essentially thicker than the plate floors, assure the good heat supply of ribs placed further from the closed channels. If the small ribs contact the side mantle of the spacer bands, heat transfer can take place on surfaces situated opposite to one another as well.

In a further advantageous design of the plate floor heat exchanger according to the invention the channels, plate floors and spacer bands are in metallic contact, and between their surfaces between the plate floors there is a material having a better heat conduction factor than that of medium flowing between the plate floors.

An advantage of the above design shape is that the heat transfer can further be improved.

The plate floor heat exchanger according to the invention can have the spacer band formed of band sections, such that clearance in the flow direction between the band sections does not preferably surpass the maximum width of the spacer band.

The plate floor heat exchanger according to the invention the spacer band and the plate floor forms common structural unit and are shaped from the same material.

Here the spacer band forms an organic unit with the plate floor, being formed with it in one operation, thereby simplifying both the manufacturing and the mounting as well.

SPECIFIC DESCRIPTION

Figure 1:
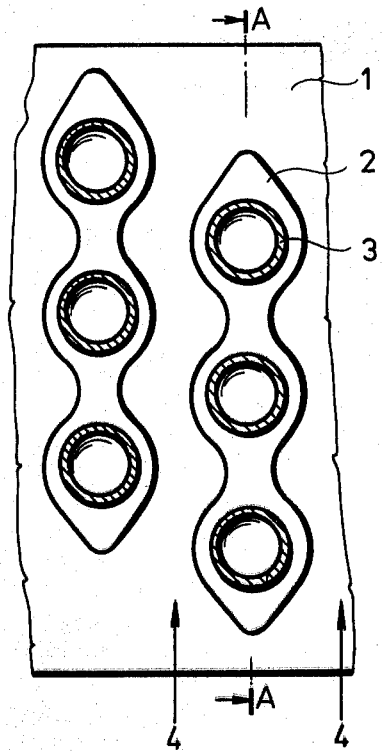
FIG. 1 is in the drawing: top view of one construction of a plate floor heat exchanger according to the invention.
Figure 2:
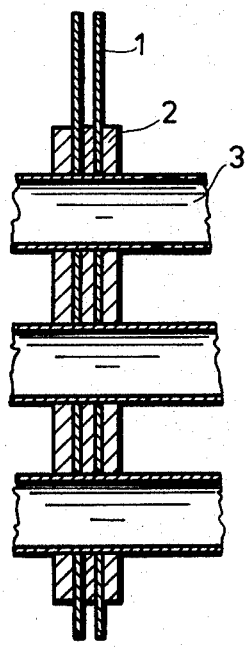
FIG. 2 is a section taken along line A—A of the plate floor heat exchanger shown in FIG. 1 in top view.

Referring to FIG. 1 and FIG. 2, the plate floor heat exchanger consists of plate floors 1, spacer bands 2, and channels 3. The spacer bands 2 are disposed between the plate floors 1 strung on the channels 3 in such a way that in the space between the spacer bands 2 a band-shaped flow space is provided for the flowing medium. The other medium taking part through the heat exchange flows in the channels 3.

Figure 3:
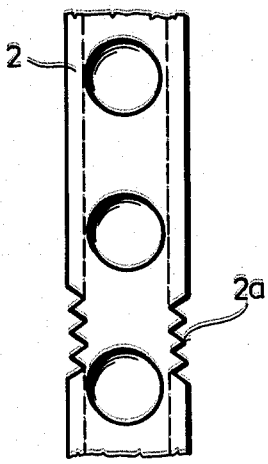
FIGS. 3–5 are top views of various constructions of the spacer bands.

FIG. 3 shows the spacer band 2 which is provided with an indentation 2*a* on the side mantle or edge, the turbulence brought about by the above indentation 2*a* improving the heat transfer without significantly increasing the resistance of medium.

Figure 4:
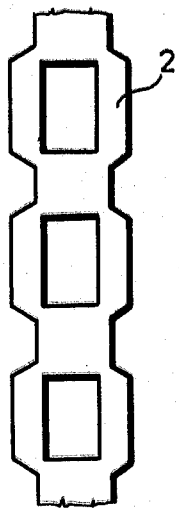

In FIG. 4 the spacer band 2 of varying width along the long axis is illustrated at which the width reduction increases the size of free heat transfer surface of the plate floors 1.

Figures 5, 6, 8:
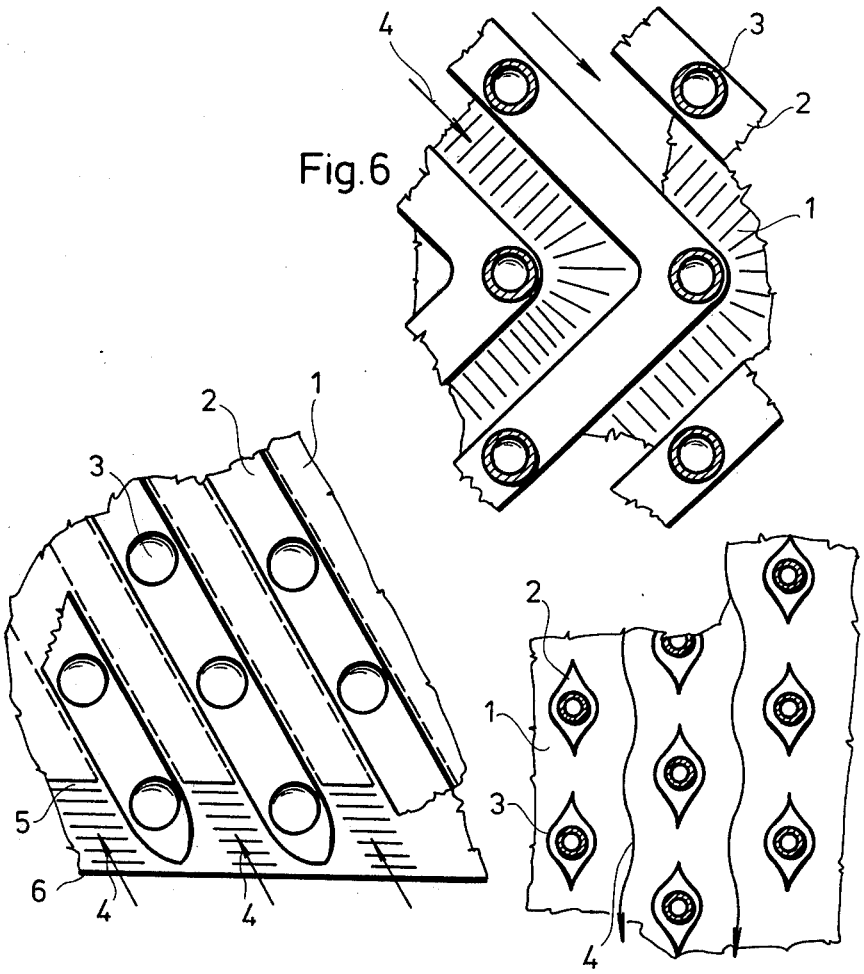
FIGS. 6–8 show further designs of the plate floor heat exchanger according to the invention.

According to FIG. 5 the plate floors 1 are provided with small ribs 5 evoking turbulence which improve heat transfer. The flow direction 4 developing in the heat exchanger includes an angle differing from the right angle of the plane of entrance as it is parallel to the long axis of the spacer bands 2. FIG. 6 shows that the spacer bands 2 are planar curves, thus the flow direction 4 of the flowing medium changes within the heat exchanger, its residence time increases.

Figure 7:
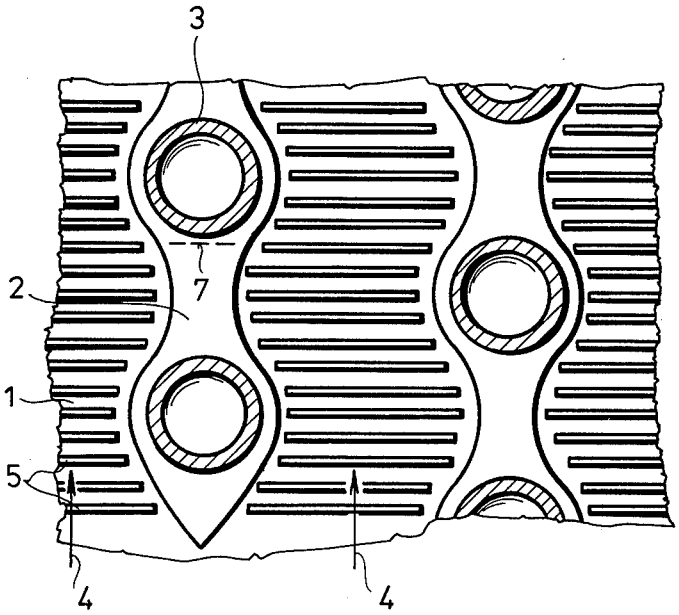

As illustrated by FIG. 7, in the construction shape of the plate floor heat exchanger in accordance with the invention, the small ribs 5 shaped on the surface of plate floors 1 extend practically to the longitudinal edges of the spacer bands 2; thus the heat supply of ribs located further from the channels 3 is assured through heat conduction of the spacer bands 2 having a far greater cross section than that of the plate floors 1. From the FIGURE it can be seen that cross section 7 is traversed by the combined heat flux of many small ribs 5. This cross section 7, at the application of spacer bands 2 is significantly greater than in case of application of spacer rings, thus the heat resistance decreases in a great extent.

In the embodiment heat exchanger shown in FIG. 8, in accordance with the invention, the spacer bands 2 are formed of band sections between which there is an air space, but they combined are forming a band-like or strip-shaped flow space suitable to conduct the flowing medium, where also the flow direction 4 is determined.

An advantage of the plate floor heat exchanger according to the invention, is that with its application the dead spaces and turbulence disengagements exceptionally damaging both in thermodynamic and fluid mechanic aspects, when the above come into being within the heat exchanger can both be eliminated. The resistance of medium of the heat exchanger can be made independent of the cross sectional shape of the channels; thus from a thermodynamic, manufacture technological, etc. point of view it can be changed for the optimum since the fluid mechanical optimum can be approximated by means of the construction of the spacer bands.

It is another advantage that the heat load of channels along their periphery becomes a uniform one. The resistance of the heat exchanger significantly decreases, thus the energy necessary to induce flow of the medium amongst the plate floors is less, therefore the specific ventilation performance the ratio of the transmitted energy and the energy sustaining the flow of medium, increases.

A further advantage of the heat exchanger according to the invention, is the simplicity of its manufacture, maintenance, and the stability of its properties with time.

What is claimed is:

1. A plate floor heat exchanger comprising:

at least two spaced-apart mutually parallel plates of thermally conductive material;

a plurality of tubes extending generally perpendicularly through said plates for conducting a first fluid therethrough; and elongated flat spacer bands disposed between said plates and spacing the same apart whereby said plates directly abut opposite faces of said bands, each spacer band being transversed by a respective group of said tubes in a linear row whereby longitudinal edges of said bands define between them flow channels for a second fluid between said plates, the width of each band alternating along the length thereof between regions of greatest width and regions of smaller width, the region of greatest width being located in the region of a respective tube, the regions of smaller width being located in regions between the tubes of the respective group, said tubes, said bands and said plates being in heat conductive contact with one another, said bands being staggered such that a relative wide part of one of said bands is juxtaposed with a relatively narrow part of one another of said bands spaced from said one of said bands.

2. The heat exchanger defined in claim 1 wherein said tubes have circular cross sections.

3. The heat exchanger defined in claim 1 wherein the width of each spacer band between two locations of identical width changes continuously along the bend and the first derivative of the function describing the changing width has at most one region of negative sign and one region of positive sign.

4. The heat exchanger defined in claim 1 wherein said bands are curved to increase the residence time of said second fluid.

5. The heat exchanger defined in claim 1 wherein said plates are formed between said bands with ribs extending substantially to said longitudinally edges of said bands and transverse thereto.

6. The heat exchanger defined in claim 1 wherein the spacer bands are formed in sections with a clearance in the flow direction of said second fluid which is less than the greatest width of the spacer bands.

* * * * *